US007592793B2

(12) United States Patent
Yang

(10) Patent No.: US 7,592,793 B2
(45) Date of Patent: Sep. 22, 2009

(54) VOLTAGE REGULATOR PROVIDING POWER FROM AC POWER SOURCE

(75) Inventor: Ta-Yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 11/477,494

(22) Filed: Jun. 30, 2006

(65) Prior Publication Data

US 2008/0001591 A1 Jan. 3, 2008

(51) Int. Cl.
*G05F 1/569* (2006.01)
*G05F 1/575* (2006.01)

(52) U.S. Cl. ..... 323/299; 323/266; 323/284; 323/285

(58) Field of Classification Search ..... 323/265, 323/282, 284, 285, 299, 266, 268, 271; 361/18, 361/90, 91.1, 91.2, 92, 93.7
See application file for complete search history.

(56) References Cited

U.S. PATENT DOCUMENTS 6,169,391 B1 * 1/2001 Lei ..... 323/266
6,452,369 B1 * 9/2002 Lang ..... 323/285
6,982,888 B2 * 1/2006 Bruno ..... 363/89
7,057,378 B2 * 6/2006 Oyama et al. ..... 323/268
7,064,534 B2 * 6/2006 McClure et al. ..... 323/314
7,099,135 B2 * 8/2006 Ball et al. ..... 361/93.9

* cited by examiner

*Primary Examiner*—Gary L Laxton
(74) *Attorney, Agent, or Firm*—Rosenberg, Klein & Lee

(57) ABSTRACT

A high efficiency voltage regulator for generating a regulated output voltage from an AC power source is disclosed. It includes a switch coupled to a voltage source from the AC power source to provide a supply voltage. An input detection circuit is coupled to the voltage source to turn off the switch when the voltage level of the voltage source is higher than a threshold voltage. An output detection circuit is connected to the supply voltage to turn off the switch once the voltage level of the supply voltage is higher than an output-over-voltage threshold. The switch can only be turned on when the voltage level of the voltage source is lower than the threshold voltage and the voltage level of the supply voltage is lower than a hysteresis threshold.

20 Claims, 5 Drawing Sheets

VOLTAGE REGULATOR PROVIDING POWER FROM AC POWER SOURCE

BACKGROUND OF THE INVENTION

1. Field of the Invention

The present invention relates to a power converter. More particularly, the present invention relates to a voltage regulator.

2. Description of Related Art

FIG. 1 shows a traditional voltage regulator for supplying a regulated voltage $V_Z$ from a line voltage $V_{AC}$. A rectifier circuit 10 including a plurality of rectifiers is coupled to the line voltage $V_{AC}$ and provides the rectification to generate an input voltage $V_{IN}$. A capacitor 11 is connected from the input voltage $V_{IN}$ to a capacitor 15 to produce the regulated voltage $V_Z$. A zener diode 16 is connected to the capacitor 15 for the regulation. A resistor 12 is used for the discharge of the capacitor 11. This traditional voltage regulator has been widely used in home appliances, such as coffee maker, cooling fan and remote controller, etc. However, the drawback of this traditional voltage regulator is high power consumption, particularly for light load and no load situations. Both the resistor 12 and the zener diode 16 cause significant power losses. Therefore, reducing the power loss is required. The object of present invention is to provide a high efficiency voltage regulator for generating a regulated voltage from an AC power source.

SUMMARY OF THE INVENTION

The present invention provides a voltage regulator includes a switch coupled to receive a voltage source for producing a supply voltage at the output terminal of the voltage regulator. An input detection circuit is coupled to the voltage source to generate a control signal in response to the voltage level of the voltage source. The control signal is utilized to turn off the switch when the voltage level of the voltage source is higher than a threshold voltage. An output detection circuit is coupled to the supply voltage to generate a first enable signal and a second enable signal in response to the voltage level of the supply voltage. The first enable signal is coupled to switch off the switch once the voltage level of the supply voltage is higher than an output-over-voltage threshold. The switch can only be turned on when the voltage level of the voltage source is lower than the threshold voltage and the voltage level of the supply voltage is lower than a hysteresis threshold. The second enable signal is utilized to disable a regulator when the supply voltage is lower than an output-under-voltage threshold. The regulator is coupled to the supply voltage to generate a regulated output voltage.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings.

DETAILED DESCRIPTION OF THE INVENTION

Figure 1:
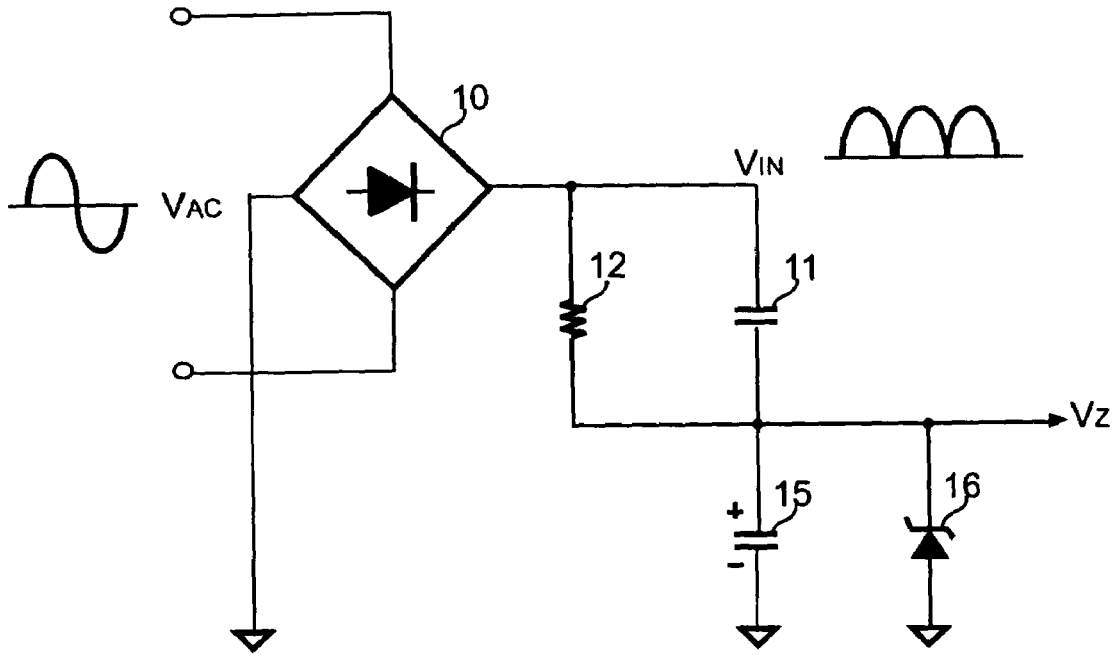
FIG.1(Prior Art)
FIG. 1 shows a circuit diagram of a traditional voltage regulator.
Figure 2:
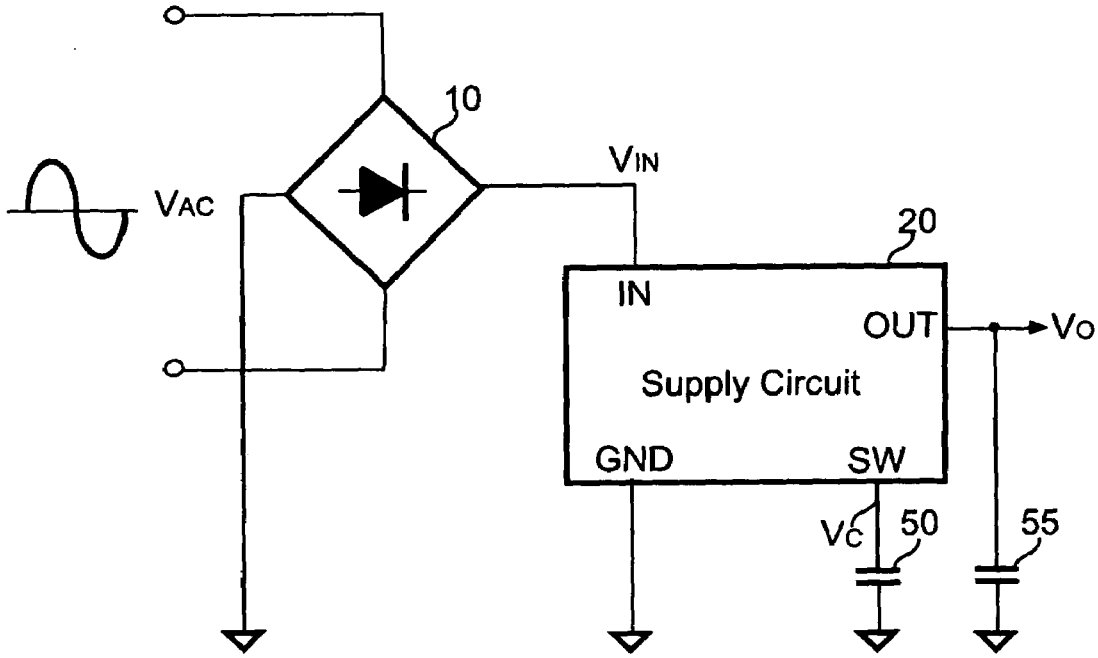
FIG. 2 shows a circuit diagram of a preferred embodiment of a voltage regulator according to the present invention.

FIG. 2 shows a circuit diagram of a preferred embodiment of a voltage regulator according to the present invention. The rectifier circuit 10 includes a plurality of rectifiers. The rectifier circuit 10 is coupled to receive the line voltage $V_{AC}$ to produce the input voltage $V_{IN}$ coupled to an input terminal IN of a supply circuit 20. The line voltage $V_{AC}$ is an AC power source. The input voltage $V_{IN}$ is a voltage source and is rectified by the rectifier circuit 10. The supply circuit 20 generates a supply voltage $V_C$ at a first output terminal SW. Furthermore, the supply circuit 20 will generate a regulated output voltage $V_O$ at the second output terminal OUT. A ground terminal GND of the supply circuit 20 is coupled to the ground. A capacitor 50 is connected to the first output terminal SW for holding energy. Furthermore a capacitor 55 is connected to the second output terminal OUT. The voltage regulator is also called a voltage regulation circuit or a power supply circuit.

Figure 3:
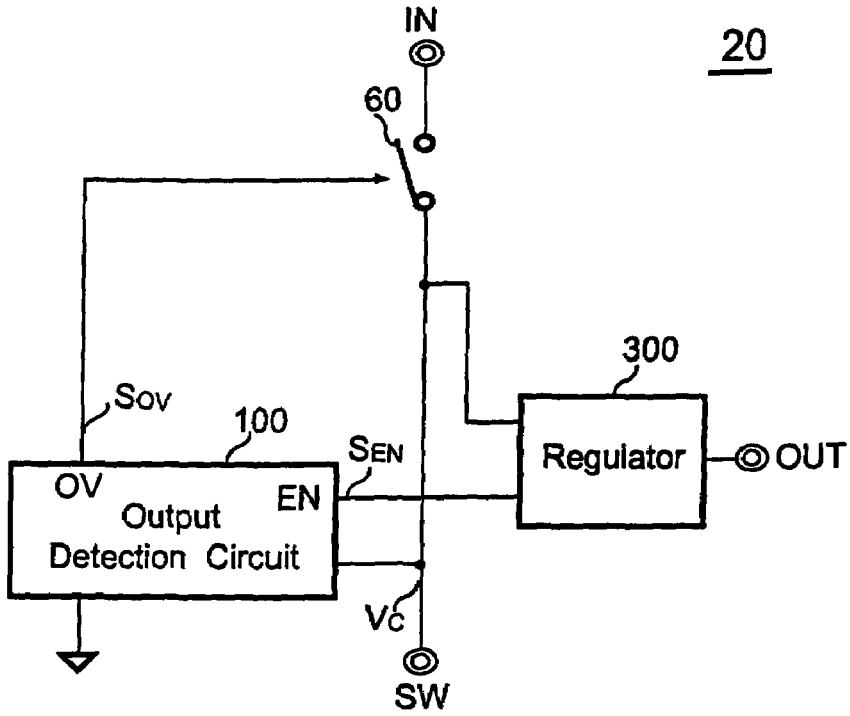
FIG. 3 shows a circuit diagram of a preferred embodiment of a supply circuit of the voltage regulator according to the present invention.

FIG. 3 is a circuit diagram of a preferred embodiment of the supply circuit 20 of the voltage regulator. The supply circuit 20 comprises a switch 60 coupled to the input terminal IN to receive the input voltage $V_{IN}$ for providing the supply voltage $V_C$ at the first output terminal SW. An output detection circuit 100 is coupled to the first output terminal SW to detect the supply voltage $V_C$ for generating a first enable signal $S_{OV}$ at a first enable terminal OV of the output detection circuit 100 in response to the voltage level of the supply voltage $V_C$. The first enable signal $S_{OV}$ is coupled to switch off the switch 60 when the voltage level of the supply voltage $V_C$ is higher than an output-over-voltage threshold. Besides, the output detection circuit 100 generates a second enable signal $S_{EN}$ at a second enable terminal EN of the output detection circuit 100 in response to the voltage level of the supply voltage $V_C$. The second enable signal $S_{EN}$ is connected to a regulator 300 to turn off the regulator 300 when the voltage level of the supply voltage $V_C$ is lower than an output-under-voltage threshold. The regulator 300 is coupled to the supply voltage $V_C$ at the first output terminal SW to generate the regulated output voltage $V_O$. The regulated output voltage $V_O$ is coupled to the second output terminal OUT.

Figure 4:
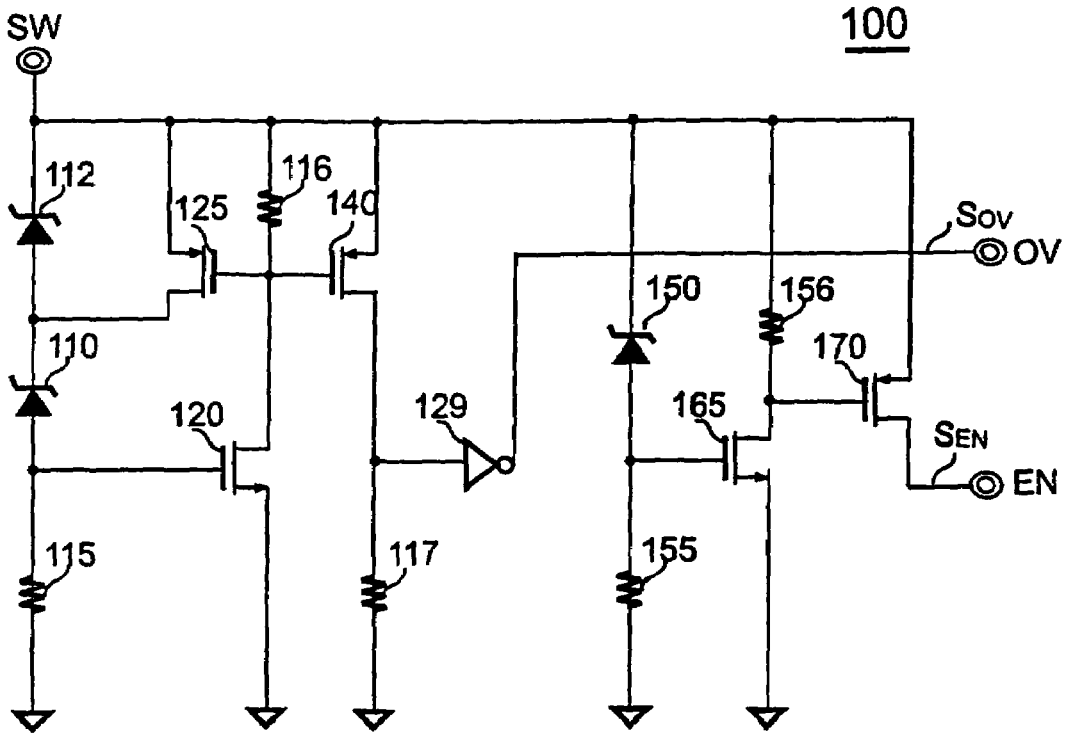
FIG. 4 shows a circuit diagram of a preferred embodiment of an output detection circuit of the supply circuit according to the present invention.

FIG. 4 shows a circuit diagram of a preferred embodiment of the output detection circuit 100. Zener diodes 110 and 112 are connected in serial. The zener diode 112 is further connected to the first output terminal SW to detect the supply voltage $V_C$. The zener diode 110 is connected to a resistor 115. The resistor 115 is further coupled to a transistor 120. The resistor 115 is used to turn on the transistor 120 when the voltage level of the supply voltage $V_C$ is higher than the voltage of zener diodes 110 and 112. A transistor 125 is parallel connected with the zener diode 112 to short circuit the zener diode 112 when the transistor 120 is turned on, which achieve a hysteresis for detecting the over voltage of the supply voltage $V_C$. The zener voltage of the zener diodes 110 and 112 determines the output-over-voltage threshold. The zener voltage of the zener diode 112 determines a hysteresis threshold for the hysteresis. The first enable signal $S_{OV}$ will switch on the switch 60 when the voltage level of the supply voltage $V_C$ is lower than the hysteresis threshold.

A transistor 140 is coupled to the transistor 120 and the first output terminal SW. The transistor 140 is turned on in response to the turn-on of the transistor 120. A resistor 116 is coupled to the first output terminal SW, the transistors 125 and 140. The resistor 116 provides a bias to transistors 125 and 140. A resistor 117 is connected to the transistor 140 and an inverter 129 to control the inverter 129 when the transistor 120 is turned on. The inverter 129 is coupled to the transistor 140. The inverter 129 is further connected to the switch 60 and generates the first enable signal $S_{OV}$ to turn off the switch 60 once the voltage level of the supply voltage $V_C$ is higher than the output-over-voltage threshold.

A zener diode 150 is also connected to the first output terminal SW to detect the supply voltage $V_C$. A resistor 155 is connected to the zener diode 150 and a transistor 165 to turn on the transistor 165 once the voltage level of the supply voltage $V_C$ is higher than the output-under-voltage threshold. The zener voltage of the zener diode 150 determines the output-under-voltage threshold. A resistor 156 is coupled to the first output terminal SW and a transistor 170. The transistor 170 is further coupled to the first output terminal SW and the transistor 165. The transistor 170 generates the second enable signal $S_{EN}$ when the voltage level of the supply voltage $V_C$ is lower than the output-under-voltage threshold. The voltage level of the output-over-voltage threshold is higher than the hysteresis threshold. The voltage level of the hysteresis threshold is higher than the output-under-voltage threshold.

Figure 5:
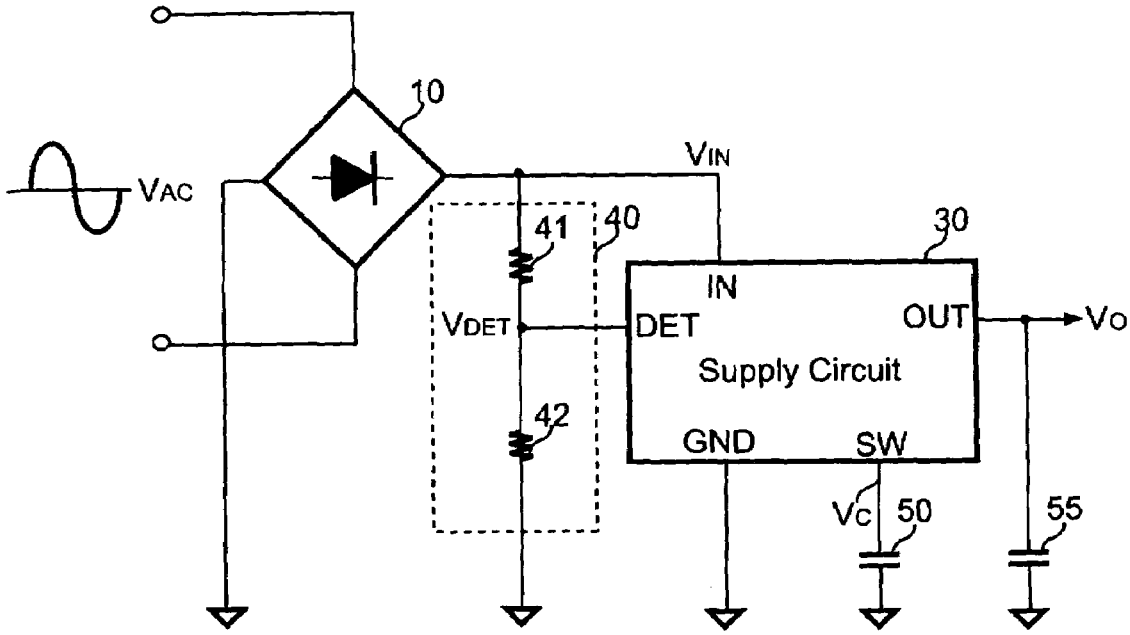
FIG. 5 shows a circuit diagram of another preferred embodiment of the voltage regulator according to the present invention.
Figure 6:
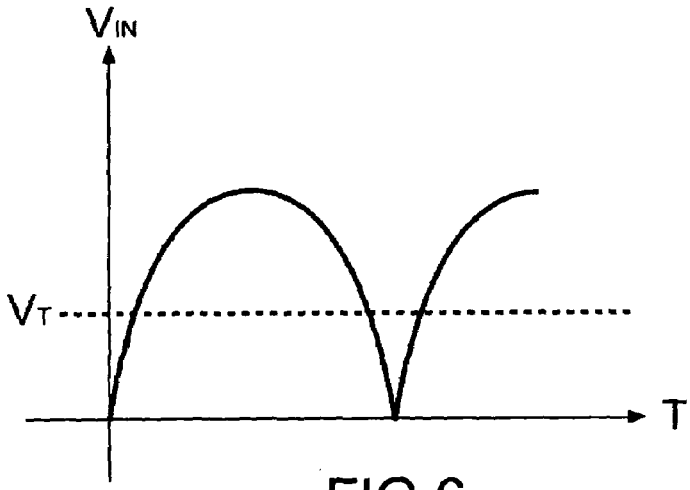
FIG. 6 shows the input voltage waveform of the voltage regulator shown in FIG. 5 according to the present invention.

FIG. 5 shows a circuit diagram of another preferred embodiment of the voltage regulator, in which the control of a supply circuit 30 is synchronized with the line voltage $V_{AC}$. The input of the supply circuit 30 can only be turned on when the input voltage $V_{IN}$ is lower than an input threshold voltage, which reduces the switching loss of the switch 60 and improves the efficiency of the voltage regulator. FIG. 6 shows the waveform of the input voltage $V_{IN}$, in which the input voltage $V_{IN}$ is delivered to the first output terminal SW when the input voltage $V_{IN}$ is lower than a threshold voltage $V_T$. The threshold voltage $V_T$ is correlated to the input threshold voltage. The supply circuit 30 includes a detection terminal DET coupled to the input voltage $V_{IN}$ through a voltage divider 40. The voltage divider 40 comprises resistors 41 and 42. The resistors 41 and 42 are coupled in series.

Figure 7:
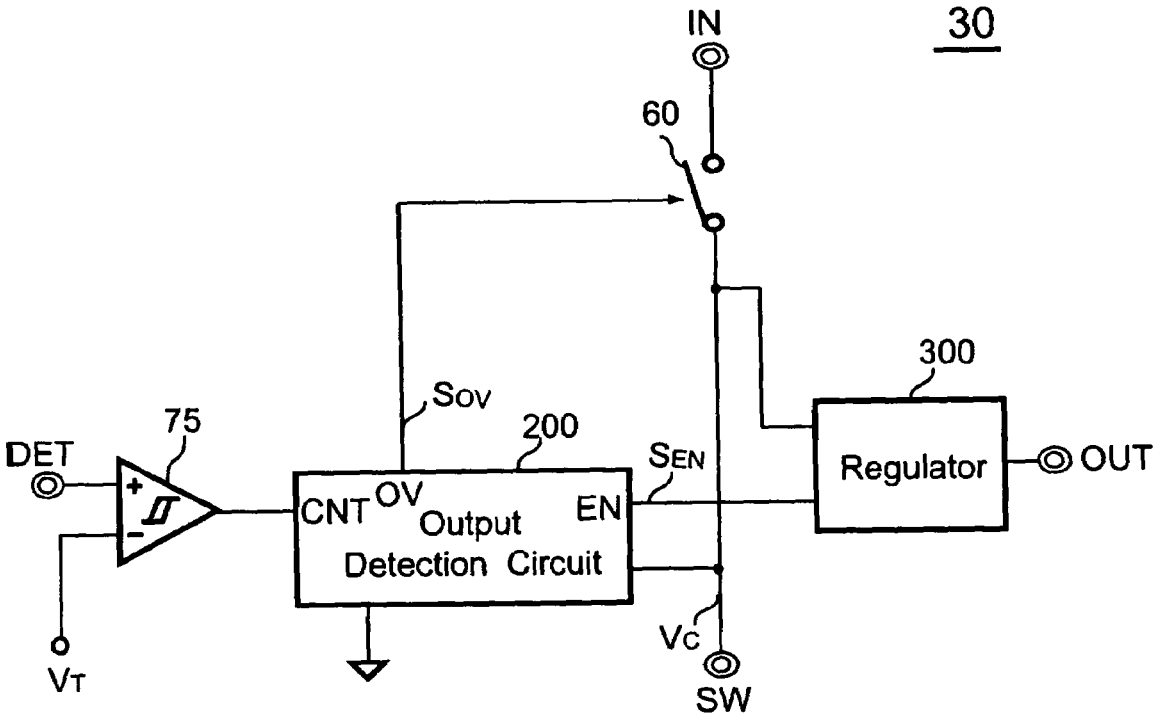
FIG. 7 shows a circuit diagram of a preferred embodiment of the supply circuit of the voltage regulator shown in FIG. 5 according to the present invention.

FIG. 7 shows a preferred embodiment of the supply circuit 30 of the voltage regulator shown in FIG. 5. The supply circuit 30 comprises the switch 60 coupled to the input terminal IN to receive the voltage source $V_{IN}$ for providing the supply voltage $V_C$ at the first output terminal SW. The input voltage $V_{IN}$ is the voltage source. A positive input terminal of an input detection circuit 75 is coupled to the detection terminal DET to detect the input voltage $V_{IN}$ via the voltage divider 40 and generate a control signal in response to the voltage level of the input voltage $V_{IN}$. The control signal is coupled to an input terminal CNT of an output detection circuit 200 to turn off the switch 60 when the voltage level of the input voltage $V_{IN}$ is higher than the threshold voltage $V_T$. The input detection circuit 75 includes the threshold voltage $V_T$ that is correlated to the input threshold voltage. The threshold voltage $V_T$ is coupled a negative input terminal of the input detection circuit 75.

The output detection circuit 200 is coupled to the first output terminal SW to detect the supply voltage $V_C$ and generate the first enable signal $S_{OV}$ at the first enable terminal OV in response to the voltage level of the supply voltage $V_C$. The first enable signal $S_{OV}$ is coupled to the switch 60 to switch off the switch 60 when the voltage level of the supply voltage $V_C$ is higher than the output-over-voltage threshold. Besides, the output detection circuit 200 generates the second enable signal $S_{EN}$ at the second enable terminal EN in response to the voltage level of the supply voltage $V_C$. The second enable signal $S_{EN}$ is connected to the regulator 300 to turn off the regulator 300 when the voltage level of the supply voltage $V_C$ is lower than the output-under-voltage threshold. The regulator 300 is coupled to the second output terminal OUT.

Figure 8:
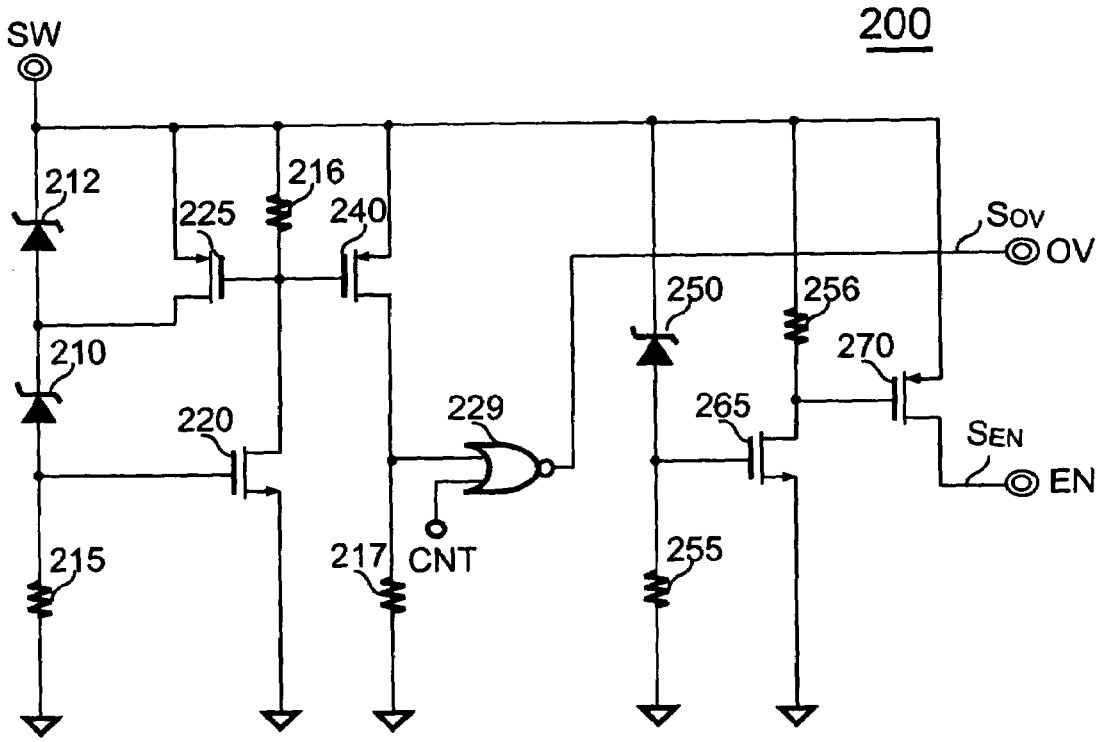
FIG. 8 shows a circuit diagram of a preferred embodiment of the output detection circuit of the supply circuit shown in FIG. 7 according to the present invention.

The circuit schematic of the output detection circuit 200 is shown in FIG. 8. Zener diodes 210 and 212 are connected in serial. The zener diode 212 is further connected to the first output terminal SW to detect the supply voltage $V_C$. The zener diode 210 is connected to a resistor 215. The resistor 215 is further coupled to a transistor 220. The resistor 215 is used to turn on the transistor 220 when the voltage of the supply voltage $V_C$ is higher than the voltage of zener diodes 210 and 212. A transistor 225 is parallel connected with the zener diode 212 to short circuit the zener diode 212 when the transistor 220 is turned on, which achieve the hysteresis for detecting the over voltage of the supply voltage $V_C$. The zener voltage of the zener diodes 210 and 212 determines the output-over-voltage threshold. The zener voltage of the zener diode 212 determines the hysteresis threshold for the hysteresis. The first enable signal $S_{OV}$ will switch on the switch 60 when the voltage level of the supply voltage $V_C$ is lower than the hysteresis threshold.

A transistor 240 is coupled to the transistor 220 and the first output terminal SW. The transistor 240 is turned on in response to the turn-on of the transistor 220. A resistor 216 is coupled to the first output terminal SW, the transistors 225 and 240. The resistor 216 provides a bias to transistors 225 and 240. A resistor 217 is connected to the transistor 240 and an input terminal of an NOR gate 229 to control the NOR gate 229 when the transistor 220 is turned on. Another input terminal of the NOR gate 229 is connected to the input terminal CNT of the output detection circuit 200 to receive the control signal. An output terminal of the NOR gate 229 is connected to the switch 60 and generates the first enable signal $S_{OV}$ to turn off the switch 60 once the voltage level of the supply voltage $V_C$ is higher than the output-over-voltage threshold or the voltage level of the input voltage $V_{IN}$ is higher than the threshold voltage $V_T$.

A zener diode 250 is also connected to the first output terminal SW to detect the supply voltage $V_C$. A resistor 255 is connected to the zener diode 250 and a transistor 265 to turn on the transistor 265 once the voltage level of the supply voltage $V_C$ is higher than the output-under-voltage threshold. The zener voltage of the zener diode 250 determines the output-under-voltage threshold. A resistor 256 is coupled to the first output terminal SW and a transistor 270. The transistor 270 is further coupled to the first output terminal SW and the transistor 265. The transistor 270 generates the second enable signal $S_{EN}$ when the voltage level of the supply voltage $V_C$ is lower than the output-under-voltage threshold. The voltage level of the output-over-voltage threshold is higher than the hysteresis threshold. The voltage level of the hysteresis threshold is higher then the output-under-voltage threshold.

Figure 9:
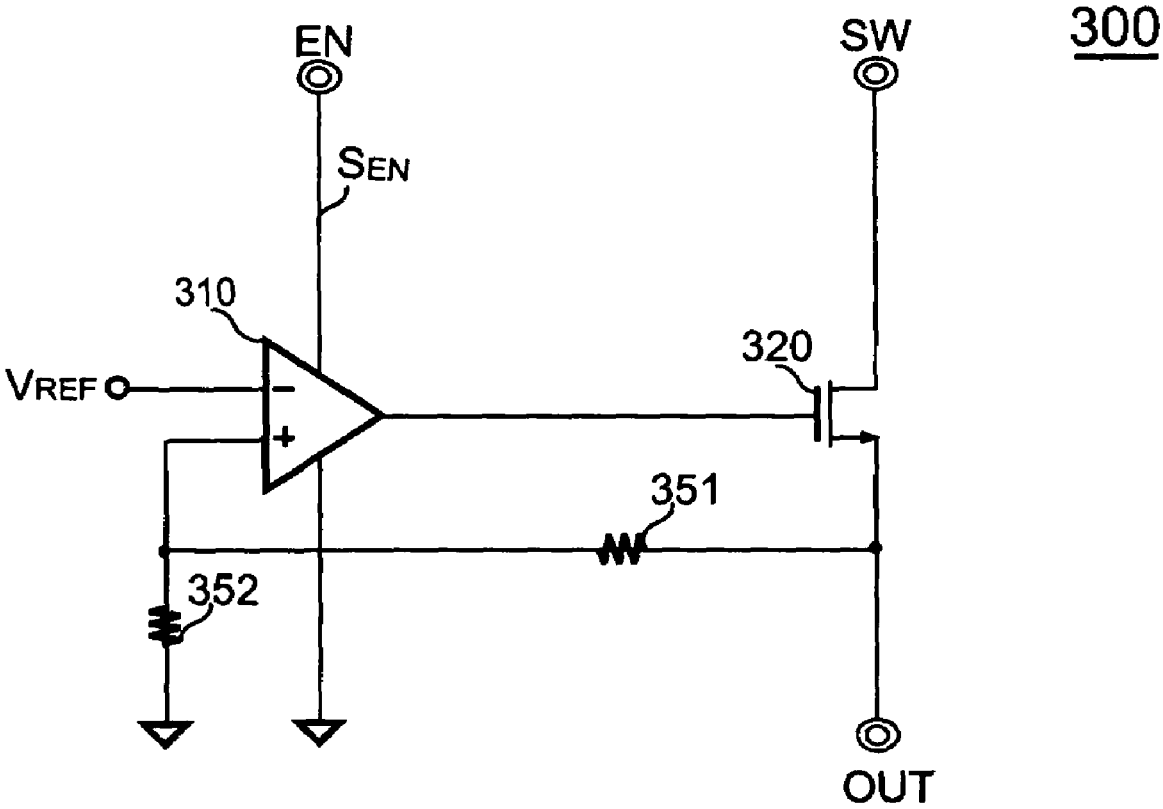
FIG. 9 shows a circuit diagram of a preferred embodiment of a regulator of the supply circuit according to the present invention.

FIG. 9 shows a circuit diagram of the regulator 300 that includes an operational amplifier 310, a pass element 320 and resistors 351, 352. The operational amplifier 310 includes a reference voltage $V_{REF}$ coupled to a negative input terminal of the operational amplifier 310. The resistor 352 is coupled to a positive input terminal of the operational amplifier 310. The second enable signal $S_{EN}$ is coupled to the operational amplifier 310 to provide a power source to operate the operational amplifier 310. The pass element 320 is coupled to the operational amplifier 310, the first output terminal SW and the second output terminal OUT. The operational amplifier 310 and the pass element 320 are disabled once the second enable signal $S_{EN}$ is disabled. The resistor 351 is coupled to the positive input terminal of the operational amplifier 310 and the pass element 320. The pass element 320 can be a transistor.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A voltage regulator comprising:

a switch coupled to a voltage source for providing a supply voltage;

an input detection circuit coupled to the voltage source to generate a control signal in response to the voltage level of the voltage source;

an output detection circuit coupled to the supply voltage to generate a first enable signal and a second enable signal in response to the voltage level of the supply voltage; and a regulator coupled to the supply voltage to generate a regulated output voltage;

wherein the control signal is coupled to the switch to turn off the switch once the voltage level of the voltage source is higher than a threshold voltage, the first enable signal is further coupled to the switch to switch off the switch when the voltage level of the supply voltage is higher than an output-over-voltage threshold, the second enable signal is utilized to turn off the regulator once the voltage level of the supply voltage is lower than an output-under-voltage threshold.

2. The voltage regulator as claimed in claim 1, wherein the output detection circuit includes a hysteresis for generating the first enable signal, the first enable signal is coupled to enable the switch once the voltage level of the supply voltage is lower than a hysteresis threshold, in which the output-over-voltage threshold is higher than the hysteresis threshold, and the hysteresis threshold is higher than the output-under-voltage threshold.

3. The voltage regulator as claimed in claim 1, wherein the voltage source is coupled to an AC power source through a rectifier circuit having a plurality of rectifiers.

4. The voltage regulator as claimed in claim 1, wherein the input detection circuit is coupled to the voltage source through a voltage divider.

5. A voltage regulation circuit comprising:

a switch coupled to a voltage source for providing a supply voltage;

an output detection circuit coupled to the supply voltage to generate a first enable signal and a second enable signal in response to the voltage level of the supply voltage; and a regulator coupled to the supply voltage to generate a regulated output voltage;

wherein the first enable signal is coupled to the switch to turn off the switch when the voltage level of the supply voltage is higher than an output-over-voltage threshold, the second enable signal is utilized to disable the regulator when the voltage level of the supply voltage is lower than an output-under-voltage threshold.

6. The voltage regulation circuit as claimed in claim 5, wherein the first enable signal is utilized to turn on the switch once the voltage level of the supply voltage is lower than a hysteresis threshold, in which the output-over-voltage threshold is higher than the hysteresis threshold.

7. The voltage regulation circuit as claimed in claim 5, wherein the voltage source is coupled to an AC power source through a rectifier circuit having a plurality of rectifiers.

8. The voltage regulation circuit as claimed in claim 5, further comprises an input detection circuit coupled to the voltage source to turn off the switch once the voltage level of the voltage source is higher than a threshold voltage.

9. The voltage regulation circuit as claimed in claim 8, wherein the input detection circuit is coupled to the voltage source through a voltage divider.

10. A power supply circuit comprising:

a switch coupled to a voltage source for providing a supply voltage;

a regulator coupled to the supply voltage to generate a regulated output voltage;

an input detection circuit coupled to the voltage source to turn on the switch once the voltage level of the voltage source is lower than a threshold; and an output detection circuit coupled to the supply voltage to disable the regulator when the voltage level of the supply voltage is lower than an output-under-voltage threshold.

11. The power supply circuit as claimed in claim 10, wherein the voltage source is coupled to an AC power source through a rectifier circuit having a plurality of rectifiers.

12. The power supply circuit as claimed in claim 10, wherein the input detection circuit generates a control signal in response to the voltage level of the voltage source, the control signal is coupled to the switch to turn on the switch once the voltage level of the voltage source is lower than the threshold voltage.

13. The power supply circuit as claimed in claim 10, wherein the input detection circuit is coupled to the voltage source through a voltage divider.

14. The power supply circuit as claimed in claim 10, wherein the output detection circuit is coupled to the supply voltage to turn off the switch when the voltage level of the supply voltage is higher than an output-over-voltage threshold.

15. A voltage regulator comprising:

a switch providing a supply voltage in response to a voltage source;

an input detection circuit generating a control signal in response to the voltage level of the voltage source;

an output detection circuit generating a first enable signal and a second enable signal in response to the voltage level of the supply voltage; and a regulator generating a regulated output voltage in response to the supply voltage;

wherein the control signal turns off the switch once the voltage level of the voltage source is higher than a threshold voltage, the first enable signal switches off the switch when the voltage level of the supply voltage is higher than an output-over-voltage threshold, the second enable signal turns off the regulator once the voltage level of the supply voltage is lower than an output-under-voltage threshold.

16. The voltage regulator as claimed in claim 15, wherein the output detection circuit includes a hysteresis for generating the first enable signal, the first enable signal is coupled to enable the switch once the voltage level of the supply voltage is lower than a hysteresis threshold, in which the output-over-voltage threshold is higher than the hysteresis threshold, and the hysteresis threshold is higher than the output-under-voltage threshold.

17. A voltage regulation circuit comprising:

a switch providing a supply voltage in response to a voltage source;

an output detection circuit generating an first enable signal and a second enable signal in response to the voltage level of the supply voltage; and a regulator generating a regulated output voltage in response to the supply voltage;

wherein the first enable signal turns off the switch when the voltage level of the supply voltage is higher than an output-over-voltage threshold, the second enable signal is utilized to disable the regulator when the voltage level of the supply voltage is lower than an output-under-voltage threshold.

18. The voltage regulation circuit as claimed in claim 17, wherein the first enable signal is utilized to turn on the switch once the voltage level of the supply voltage is lower than a hysteresis threshold, in which the output-over-voltage threshold is higher than the hysteresis threshold.

19. A power supply circuit comprising:

a switch providing a supply voltage in response to a voltage source;

a regulator generating a regulated output voltage in response to the supply voltage;

an input detection circuit turning on the switch once the voltage level of the voltage source is lower than a threshold; and an output detection circuit disabling the regulator when the voltage level of the supply voltage is lower than an output-under-voltage threshold.

20. The power supply circuit as claimed in claim 19, wherein the input detection circuit generates a control signal in response to the voltage level of the voltage source, the control signal is coupled to the switch to turn on the switch once the voltage level of the voltage source is lower than the threshold voltage.

* * * * *